US005174044A

United States Patent [19]

Jacobs et al.

[11] Patent Number: 5,174,044

[45] Date of Patent: Dec. 29, 1992

[54] CONTROL OF THE CONCENTRATION OF SOLVENTS IN A DRYER

[75] Inventors: Thomas G. Jacobs, Cuijk; Clemens J. M. de Vroome, Beugen, both of Netherlands

[73] Assignee: Stork Contiweb B.V., Boxmeer, Netherlands

[21] Appl. No.: 604,944

[22] Filed: Oct. 29, 1990

[30] Foreign Application Priority Data

Nov. 7, 1989 [NL] Netherlands ..... 8902754

[51] Int. Cl.[5] ..... F26B 3/00

[52] U.S. Cl. ..... 34/23; 34/29; 34/44; 34/219; 34/54; 118/61

[58] Field of Search ..... 34/23, 219, 223, 224, 34/86, 54, 44, 47, 29, 51, 35; 432/59; 118/58, 61

[56] References Cited

U.S. PATENT DOCUMENTS

| | | | |
|---|---|---|---|
| 1,563,963 | 12/1925 | Byrd | 34/219 |
| 3,314,159 | 4/1967 | Betz | 34/219 |
| 3,874,091 | 4/1975 | Fukumoto | 34/160 |
| 4,026,037 | 5/1977 | Buchholz | 34/219 |
| 4,242,808 | 1/1981 | Luthi | 34/23 |
| 4,772,439 | 9/1988 | Trevino-Gonzalez | 34/219 |
| 4,942,676 | 7/1990 | Wimberger et al. | 34/51 |

FOREIGN PATENT DOCUMENTS

| | | |
|---|---|---|
| 424316 | 5/1972 | Australia . |
| 65783 | 12/1982 | European Pat. Off. . |
| 8800226 | 8/1989 | Netherlands . |

*Primary Examiner*—Henry A. Bennet
*Assistant Examiner*—Denise L. F. Gromada
*Attorney, Agent, or Firm*—Webb, Burden, Ziesenheim & Webb

[57] ABSTRACT

The invention relates to a method and apparatus for drying lengths of carrier material which have been printed with ink comprising an evaporable solvent. To maintain the concentration of the solvents evaporating from the printing ink, this concentration has to be determined. As known apparatuses for measuring the concentration are expensive, prone to faults and need regular calibration, the present invention provides a method for calculating that concentration. According to said method the concentration of the evaporated solvents in the gas mixture is determined by measurement of the temperature and flow rate of a mixture to be supplied to the burner, and by measurement of the temperature of the gas mixture heated by the burner and by measurement of the flow rate of the fuel supplied to the burner. More precisely the concentration is determined by calculation of the increase in heat of the gas mixture in the burner, the amount of heat supplied by the burner, and in which from the difference thereof the burning heat of the solvents is determined, after which with the known burning value thereof the concentration is determined.

11 Claims, 2 Drawing Sheets

CONTROL OF THE CONCENTRATION OF SOLVENTS IN A DRYER

BACKGROUND OF THE INVENTION

The present invention relates to a method for drying of lengths of carrier material, which have been printed with an ink comprising an evaporable solvent.

The present invention relates in particular to such a method, in which the lengths are guided through a chamber, a gas mixture heated by a burner is conveyed to that chamber, the gas mixture coming from such chamber is fed to the burner for heating, and a part of the gas mixture coming from the chamber is vented off.

Such a method is known from the Dutch patent application 88.00226.

The venting off of the gas mixture takes place to maintain the concentration of the solvents evaporating from the printing ink by the raised temperature beneath a certain value. Initially, this value is determined by the safety regulations, and secondly this value is determined by the fact, that the circulating gasses can of course not be saturated with solvents as otherwise no evaporation thereof can take place.

The gasses thus vented off carry a considerable amount of heat. From an energetic point of view it is thus important to keep the amount of gasses vented off as small as possible.

In such a method one aims for controlling the amount of gas mixture to be vented off such, that:

the concentration of the evaporated solvents, generally oils, is kept sufficiently beneath the value, required for safety reasons;

the concentration is kept on such a value, that printed matter of a good quality is obtained; and the amount of gasses vented off is as small as possible.

Generally the second aim leads to a much lower value of the maximal allowable concentration, so that in practice consideration is made between the second and the third aim.

To make this consideration it is necessary to determine the concentration. It is possible to measure the concentration. The known measuring equipment used therefor is expensive and prone to faults, and it has to be calibrated regularly.

The aim of the present invention is to provide a method, in which the concentration of the evaporated solvents in the gasses is determined, and in which the disadvantages, related to direct measurement thereof, are avoided.

SUMMARY OF THE INVENTION

This aim is reached, in that the concentration of the evaporated solvents is determined by calculation.

In the calculation of the concentration of the evaporated solvents one departs from some measurements; according to a preferred embodiment of the invention the following values are measured: the temperature and the flow rate of the gas mixture to be fed to the burner, the temperature of the gas mixture leaving the burner, and the flow rate of the fuel, feeding the burner.

From the flow rate of the fuel the amount of heat developed by the burner is determined; the burning value of the fuel is known. The flow rate of the gasses coming from the chamber and the temperature rise of the gas mixture having passed the burner caused by the burner, leads to the total supply of heat.

This value is compared with the amount of heat supplied by the burner. From the difference the heat value of the solvents can be determined, from which, with the help of calculated values for the burning value of the solvents, the concentration thereof can be determined.

The invention relates also to an apparatus for executing the methods set out above.

BRIEF DESCRIPTION OF THE DRAWINGS

Subsequently, the present invention will be elucidated with the help of the accompanying drawings, in which.

DESCRIPTION OF THE PREFERRED EMBODIMENTS

Figure 1:
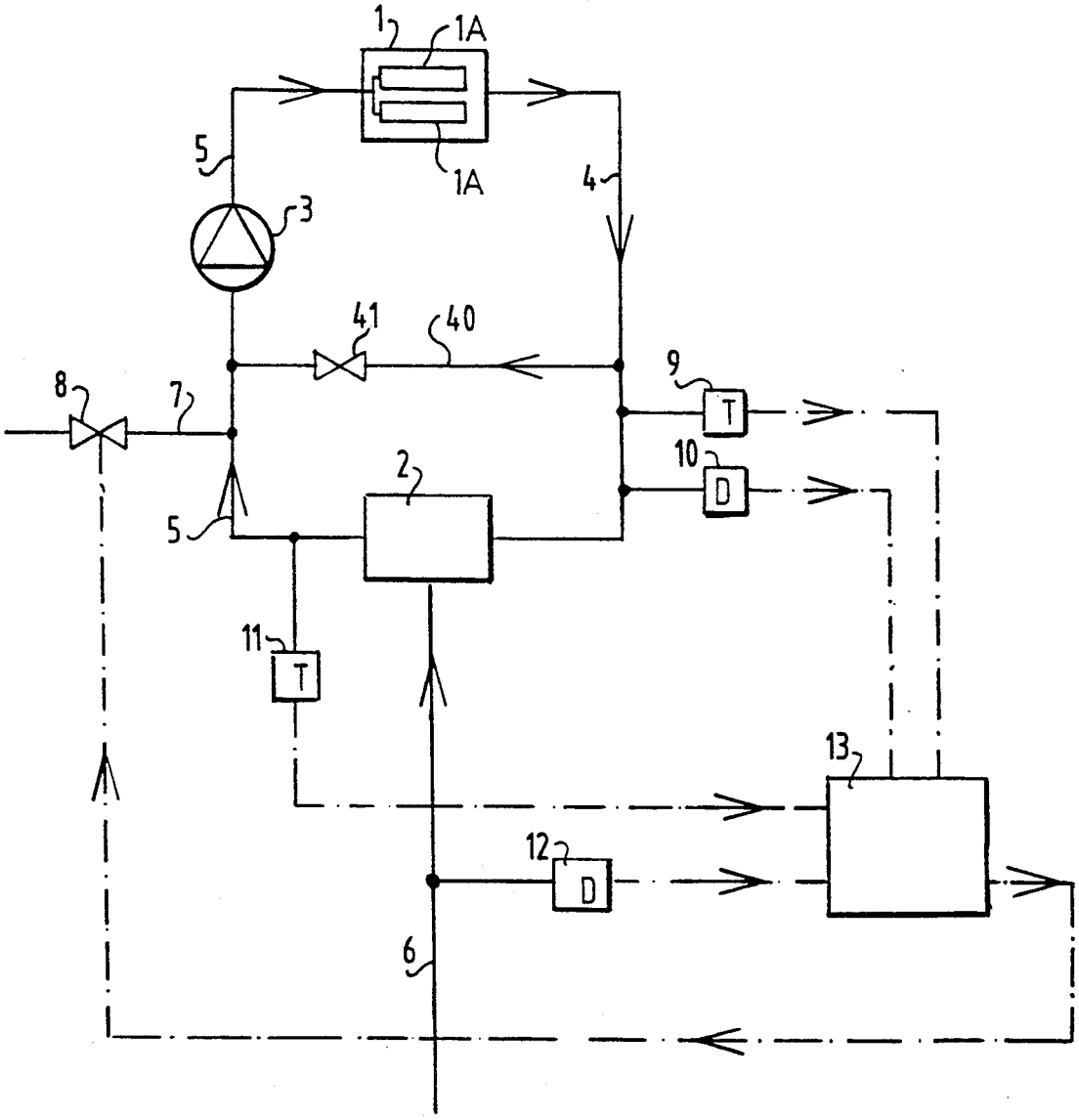
FIG. 1 is a diagram of a first embodiment of the present invention.

In the embodiment shown in FIG. 1 the lengths of material to be dried are fed through a chamber 1. In this chamber 1 sprayheads, 1A are used, which make the carrier material dry. For supplying a heated gas mixture, commonly air, a burner or heated 2 has been provided, which is connected with the chamber 1 via a channel 5, in which a ventilator 3 has been located. The gas mixture emerging from the chamber 1 is fed to the burner through a channel 4.

Also a by-pass 40 passing the burner has been provided for the gas mixture. To burn the solvents present in the gas mixture as far as possible in the burner, the temperature of the burner must be rather high, for instance about 800° C. When a gas mixture with this temperature would be fed to the lengths to be dried, these would burn. To avoid this the by-pass 40 with a controlling valve 41 has been provided, so that the heated air is mixed with cold air.

Thus a closed system is present, within which the gas mixture travels, which gas mixture exerts its drying effect on the lengths of material fed through the chamber 1, and which thus cooled down is partly heated by the burner 2, is being mixed with the not-heated air, and is fed to the chamber 1 by means of the pump 3.

Of course a fuel supply pipe 6 has been provided for supplying fuel to the burner 2. By evaporation of the solvents present in the ink, the concentration thereof in the circuit thus described is raised. For venting of gasses from the circuit a venting pipe 7 has been provided, which is connected to the channel 5 by means of a valve 8.

This decreases the amount of circulating gas, so that also means have to be provided for the supply of new gas. Therefore it is possible to provide the supply channel not depicted in the drawing for supplying gas, for instance air from outside; it is also possible to supply a part of the burned gasses of the burner to the gas circuit. This considerably enlarges the energetic efficiency.

To control the amount of gasses to be vented as accurate as possible, it is of importance, that the concentration of the evaporated solvences present in the gasses is determined very accurately.

In the present invention this is provided by the application of a temperature measuring element 9, which measures the temperature of the gas mixture to be fed to the burner 1. Further a flow rate measuring element 10 has been provided from measuring the flow rate of the gas mixture to be supplied to the burner 1.

Further a temperature measuring element 11 is present for measuring the temperature of the gas mixture leaving the burner 2, and in the fuel supply pipe 6 a flow rate meter 12 has been provided for measuring the flow rate of the fuel. The signals from these measuring elements are fed to a control element 13, which supplies a control signal to the controllable valve 8 through a signal lead 14.

The calculation of the concentration of the evaporated solvents takes place as follows: from the fuel flow rate the amount of heat which is supplied by the burner 2 to the passing gasses, is determined.

Then, by measurement of the flow rate of the gas mixture and of the temperature rise thereof, the increase of heat content of the gasses in the burner is determined. This value is compared with the heat supplied by the burner, which can be calculated from the flow rate of the fuel and the burning value thereof. From the difference of these values and the known burning value of the solvents, the concentration thereof can be calculated. The assumption is made that the solvents burn completely.

With the help of this concentration, the position of the valve 8, and thus the amount of gasses to be vented is determined. When instead of a burner an electric heating element is provided, it is also possible to measure the heat developed by such an element, and to execute an equivalent calculation.

Figure 2:
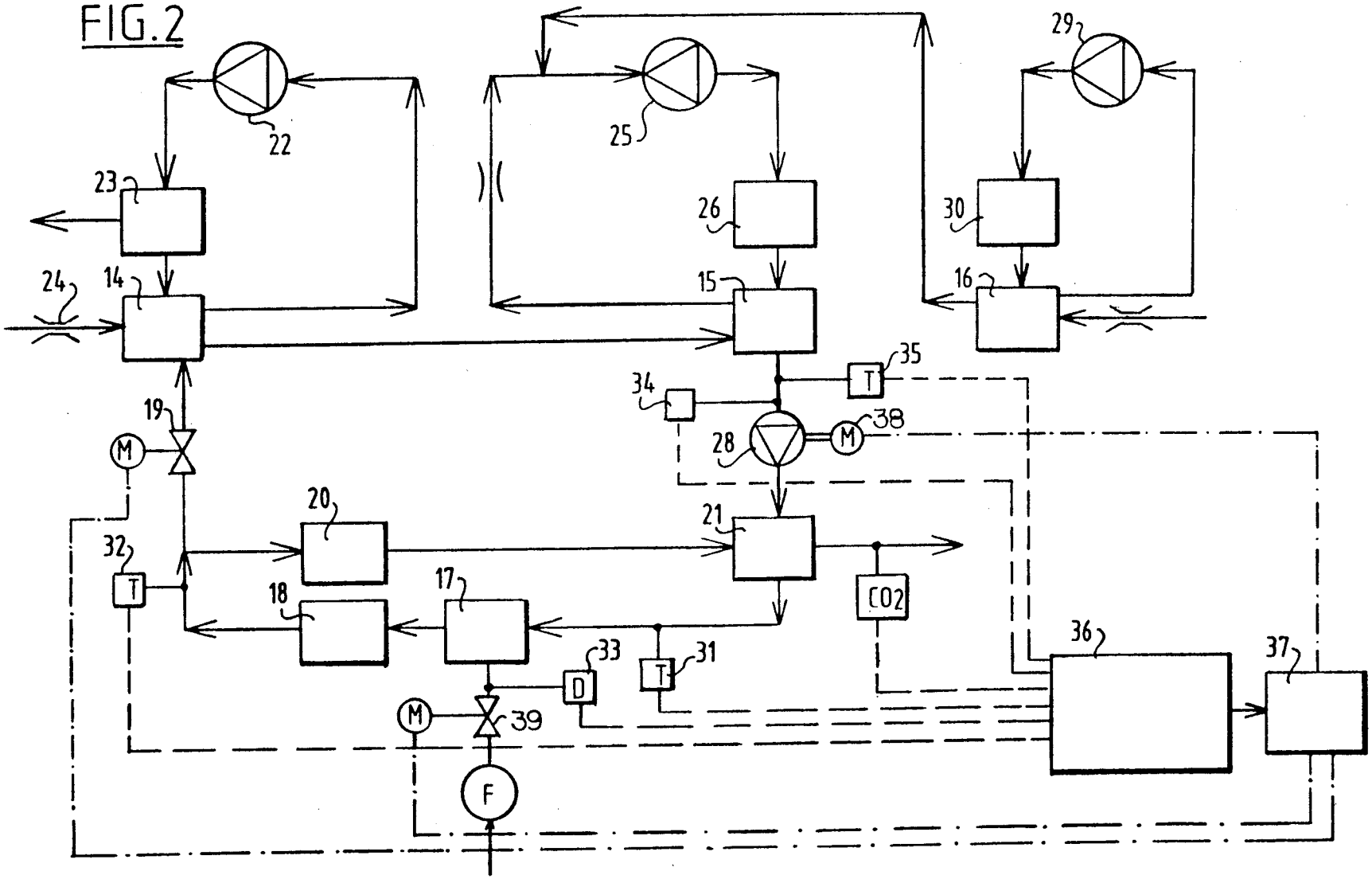
FIG. 2 is a diagram of a second embodiment of the present invention.

In the embodiment depicted in FIG. 2, the invention is integrated in a dryer with a complicated configuration. This dryer comprises three zones, first zone 14, in which the carrier material is pre-heated, a second zone 15, in which the carrier material is dried; and a third zone 16, in which the carrier material is cooled down.

The features of the invention are in particular applicable to the first and the second zone. The gas mixture emerging from the burner 17 is supplied to a first zone 14 via a first chamber 18 and a valve 19. A part of this gas mixture is supplied to a heat exchanger 21 via a second chamber 20, and is subsequently vented outwardly. In the heat exchanger 21 the gas mixture fed to the burner 17 is heated to obtain an efficiency as high as possible.

The gas mixture arriving in the second zone 14 is fed to sprayheads 23 with the help of a first ventilator 22 to heat the carrier material. Also fresh air is fed to said first zone via the entrance slit 24 for the carrier material.

A part of the gas mixture just developed goes to the second zone, from which it is guided to a second array of sprayheads 26 via a second ventilator 25. The gas mixture emerging from this zone is partially supplied via a third ventilator 28 to a heat exchanger 21 and subsequently to the burner 17.

In the third zone 16 fresh air from outside is supplied with the help of a fourth ventilator 25, which is sprayed to the carrier material by means of an array of sprayheads 30, which makes the carrier material cool down. Extra air from the third zone 16 is supplied to second zone 15, and indeed at the entrance at the second ventilator 25.

Thus the circuit of the gas mixture is closed. As appears from the diagram above, the venting of the gas from the system can be controlled through the second chamber 20 and the heat exchanger 21, which is controlled by the valve 19 together with the flow rate of the ventilator 28.

According to the invention the flow rate of the ventilator 28 is set such, that in the gas circuit a desired concentration of evaporated solvents is maintained. Also in this case this concentration is determined by measurement of the temperature of the gasses supplied to the burner by the temperature measuring element 31, the measurement of the gasses having left the burner 17 in the first chamber 18 by means of the temperature measuring element 32, the measuring of the flow rate of the fuel by means of the flow rate meter 33, and the measurement of the flow rate of the ventilator 28 with the flow rate meter 34.

Also the temperature of the gasses which are supplied to the heat exchanger 21 is measured with the help of a temperature meter 35. This temperature is used for measuring the flow rate of the mass of the gas mixture from the flow rate of the volume thereof; this specific heat is reversed proportional with the temperature. The signals coming from these measuring elements are supplied to a control element 36. This control element determines the concentration of the evaporated solvents from the measured values on a equivalent way as in the first embodiment.

The control element 36 supplies a signal to a steering element 37, which supplies signals to the control valve 19 for determining the temperature of the dryer, the motor 38 of the ventilator 28 and the motor of the fuel valve 39. Thus the relevant values can be adapted, so that an energy system is obtained with the correct properties. Of course the values thus obtained can be applied to control all the parameters in the system. This allows to control the supply of fuel just as the flow rate of the ventilator 28.

We claim:

1. A dryer for drying printed lengths of carrier materials that have been printed with an ink containing an evaporable solvent comprising:

a chamber, through which the lengths of carrier material are fed;

a supply channel connected to said chamber for supplying a heated gas mixture to said chamber;

a venting channel connected to said chamber for venting the gas mixture from the chamber having executed the drying process;

a heater for heating the gas mixture connected to said supply channel and said venting channel, said chamber, said supply channel, said venting channel and said heater forming a venting circuit; and means for venting a part of the gas mixture from the circuit having a control element for controlling the amount of gas mixture vented from the circuit as a function of the concentration of the evaporated solvent, wherein said heater is a fuel supplied burner and said means for venting a part of the gas mixture from the circuit determines the concentration of the solvents by measurement of the temperature and measurement of the flow rate of the gas mixture supplied to the burner, by measurement of the temperature of the gas mixture heated by the burner, measurement of the flow rate of the fuel supplied to the burner, and thereby calculating the burning heat supplied to the burner by the fuel, calculating the heat supplied to the gas mixture containing evaporated solvents, and calculating from the difference of the burning heat supplied by the fuel to the burner and the heat supplied by the burner to the gas mixture containing evaporated solvents the heat value of the evaporated solvents.

2. A dryer according to claim 1 wherein said control element controls the flow rate of the gas mixture supplied to the burner and the flow rate of the fuel based upon the calculated concentration of the solvents.

3. A dryer according to claim 1 further comprising a heat exchanger connected to said supply channel wherein at least a part of the gas mixture to be vented is supplied for delivering heat to said heat exchanger, and means for measuring the temperature of the gas mixture supplied to the heat exchanger to be heated.

4. A dryer according to claim 1 further comprising means for the gas mixture to bypass the burner.

5. A dryer according to claim 1 further comprising sprayers for spraying the gas mixture supplied to said chamber along sides of a path to be traveled over by the lengths of material.

6. A dryer according to claim 5 wherein said chamber includes two compartments, wherein each of said compartments include sprayheads and ventilators connected thereto.

7. A dryer according to claim 1 wherein the heat value of the evaporated solvents is assumed constant.

8. A method for drying lengths of a carrier material printed with an ink having an evaporable solvent comprising the following steps:

feeding the lengths of the carrier material through a chamber;

heating a gas mixture in a burner;

supplying the heated gas mixture to the chamber;

evaporating the solvent from the ink into the heated gas mixture in the chamber;

calculating the concentration of evaporated solvents in the gas mixture;

venting a portion of the evaporated solvent containing gas mixture, the portion of evaporated solvent containing gas mixture based upon the calculated concentration of the evaporated solvent;

supplying the remainder of the evaporated solvent containing gas mixture to the burner for heating;

measuring the temperature and the flow rate of the evaporated solvent containing gas mixture supplied to the burner;

measuring the temperature of the gas mixture heated by the burner; and measuring the flow rate of a fuel supplied to the burner.

9. The method of claim 8 further comprising the following steps:

determining the increase in heat of the gas mixture in the burner;

determining the amount of heat supplied to the burner by the fuel;

determining the concentration of evaporated solvents as a function of the difference of the heat of the gas mixture in the burner and the amount of heat supplied to the burner.

10. The method of claim 8 wherein the venting portion of the gas mixture is vented after having passed through the burner.

11. The method of claim 10 further comprising the step of passing the portion of the gas mixture through a heat exchanger.

* * * * *